US010368577B2

(12) United States Patent
Lavanchy

(10) Patent No.: US 10,368,577 B2
(45) Date of Patent: Aug. 6, 2019

(54) CAP FOR EXTINGUISHING A SMOKING ARTICLE

(71) Applicant: PHILIP MORRIS PRODUCTS S.A., Neuchatel (CH)

(72) Inventor: Frederic Lavanchy, Chavornay (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 192 days.

(21) Appl. No.: 15/314,811

(22) PCT Filed: May 29, 2015

(86) PCT No.: PCT/EP2015/062034

§ 371 (c)(1),
(2) Date: Nov. 29, 2016

(87) PCT Pub. No.: WO2015/181379

PCT Pub. Date: Dec. 3, 2015

(65) Prior Publication Data

US 2017/0196257 A1 Jul. 13, 2017

(30) Foreign Application Priority Data

May 30, 2014 (EP) ..... 14170707

(51) Int. Cl.

| | |
|---|---|
| ***B65D 85/10*** | (2006.01) |
| ***A24F 15/18*** | (2006.01) |
| ***A24F 13/18*** | (2006.01) |

(52) U.S. Cl.
CPC ..... *A24F 13/18* (2013.01); *A24F 15/18* (2013.01); *B65D 85/10* (2013.01)

(58) Field of Classification Search
CPC ..... B65D 85/10; A24F 13/18; A24F 15/18
USPC ..... 206/236, 242, 246, 276, 499, 500; 131/235.1, 256
See application file for complete search history.

(56) References Cited

U.S. PATENT DOCUMENTS 2,101,593 A * 12/1937 Osborn ..... A24F 19/14 131/256
2,233,324 A * 2/1941 Palmer ..... A24F 15/18 131/235.1

(Continued)

FOREIGN PATENT DOCUMENTS

CN 201813843 U 5/2011
CN 103028214 A 4/2013

(Continued)

OTHER PUBLICATIONS

Combined Singaporean Written Opinion and Search Report dated Jan. 29, 2018 in Singaporean Patent Application No. 11201606025, citing documents AA and AO therein, 12 pages.

(Continued)

*Primary Examiner* — Luan K Bui
(74) *Attorney, Agent, or Firm* — Oblon, McClelland, Maier & Neustadt, L.L.P.

(57) ABSTRACT

A cap for extinguishing a smoking article is provided, including a hollow cap body having an opening configured to receive a combustion zone of a smoking article, the cap body including an intumescent heat reactive material configured to deform in response to heat from the combustion zone such that at least part of the cap body fits tightly against the smoking article to substantially prevent a supply of air to the combustion zone.

12 Claims, 11 Drawing Sheets

(56) References Cited

U.S. PATENT DOCUMENTS

| | | | | | |
|---|---|---|---|---|---|
| 2,606,562 | A * | 8/1952 | Siegel | A24F 15/18 | 131/235.1 |
| 2,736,321 | A * | 2/1956 | Lewis | A24F 13/18 | 131/256 |
| 2,796,067 | A * | 6/1957 | McCutcheon | A24F 19/0064 | 131/241 |
| 3,619,216 | A * | 11/1971 | Weinstein | B65D 5/5038 | 426/119 |
| 4,714,082 | A | 12/1987 | Banerjee et al. | | |
| 4,886,076 | A * | 12/1989 | Gilbert | A24F 13/18 | 131/256 |
| 5,692,525 | A | 12/1997 | Counts et al. | | |
| 5,918,736 | A * | 7/1999 | Suzuki | A24F 13/18 | 131/235.1 |
| 5,992,420 | A | 11/1999 | Moriyama | | |
| 2005/0150803 | A1* | 7/2005 | Marroncles | B65B 43/44 | 206/503 |
| 2015/0027458 | A1* | 1/2015 | Grant | A24D 1/04 | 131/328 |

FOREIGN PATENT DOCUMENTS

| | | | |
|---|---|---|---|
| DE | G 84 12 195.5 | U1 | 1/1987 |
| FR | 2 697 410 | A1 | 5/1994 |
| GB | 2 449 441 | A | 11/2008 |
| JP | 61-34893 | | 3/1986 |
| JP | 2000-23653 | A | 1/2000 |
| JP | 2007-259839 | A | 10/2007 |
| RU | 2171 | U1 | 6/1996 |
| RU | 28588 | U1 | 4/2003 |
| WO | WO 2009/022232 | A2 | 2/2009 |
| WO | 2013/104616 | A1 | 7/2013 |

OTHER PUBLICATIONS

Office Action dated Apr. 2, 2018 in Kazakhstan Patent Application No. 2016/1156.1 (with English language translation) citing documents therein, 8 pages.

International Search Report and Written Opinion of the International Searching Authority dated Dec. 21, 2015 in PCT/EP2015/062034 filed May 29, 2015.

Extended European Search Report dated Nov. 19, 2014 in Patent Application No. 14170707.5.

Combined Office Action and Search Report dated Jan. 28, 2019 in Chinese Patent Application No. 201580026574.9, citing document AO therein, 20 pages (with English translation).

Japanese Office Action with English translation dated Apr. 11, 2019 in corresponding Japanese Patent Application No. 2016-567980, citing document AO therein (11 pages).

* cited by examiner

CAP FOR EXTINGUISHING A SMOKING ARTICLE

The present invention relates to an extinguisher for a smoking article. In particular, the present invention relates to a cap for extinguishing a single smoking article.

A number of smoking articles in which tobacco is heated rather than combusted have been proposed in the art. An aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to a physically separate aerosol-forming substrate, such as tobacco. The aerosol-forming substrate may be located within, around or downstream of the combustible heat source. For example, WO-A2-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate. During smoking, volatile compounds are released from the aerosol-forming substrate by heat transfer from the combustible heat source and entrained in air drawn through the smoking article. As the released compounds cool, they condense to form an aerosol that is inhaled by the user.

Smoking articles which include a combustible fuel element or heat source may have a combustion zone or zone of heating that is larger, more dense, and not as readily extinguished by crushing or "stubbing out" the heat source compared to a conventional cigarette, in which tobacco is burnt or combusted to heat and release volatile compounds from the tobacco. Such smoking articles may have a heat source that contains significantly more energy in the form of heat than found in the combustion zone of a conventional cigarette. Consequently, such smoking articles may require more effort to extinguish or to remove sufficient heat to facilitate disposal.

JP-A-2007-259839 discloses a cigarette pack having a plurality of cylindrical compartments for housing entire, individual cigarettes. At the bottom of each compartment is a container of extinguishing coagulant. In use, a cigarette is removed from a cylindrical compartment in the pack, smoked, then returned to the compartment after smoking so that the the remains of the cigarette are extinguished by the coagulant.

JP-A-2000-023653 discloses a cylindrical cigarette case for housing an entire, single cigarette. The case is tubular and is closed at one end. In use, a cigarette is inserted into the tubular case through the open end and is held is placed by the case while being extinguished.

CN-U-201813843 discloses a cigarette pack having an outer shell and an inner tray in which cigarettes are housed. On one side of the tray is an expandable cigarette receiving chamber for storing used cigarette butts. The chamber is defined by a flexible foil formed from a barrier material for reducing odour emanating from the used cigarette butts.

It would be desirable to provide an improved extinguisher for smoking articles, particularly one which may be used with smoking articles that include a combustible fuel element or heat source.

According to a first aspect of the invention, there is provided a cap for extinguishing a smoking article, a hollow cap body having an opening for receiving a combustion zone of a smoking article, the cap body comprising a heat reactive material which is arranged to deform in response to heat from the combustion zone of the smoking article such that at least part of the cap body fits tightly against the smoking article to substantially prevent a supply of air to the combustion zone.

With this arrangement, the smoking article can be inserted into the cap body with relative ease before the cap closes onto and extinguishes the smoking article. As the cap deforms, the supply of air can be restricted for a large area of the smoking article. This may be particularly advantageous when the cap is used with smoking articles including a combustible fuel element or heat source, because such smoking articles may have a combustion zone or zone of heating that is larger, more dense, and not as readily extinguished by crushing or "stubbing out" the heat source compared to a conventional cigarette. The cap is thus particularly suited to extinguishing smoking articles that include a combustible fuel element or heat source.

As used herein, the term 'cap' refers to a cover that is arranged to substantially surround the distal end of the smoking article but which does not enclose the entire smoking article.

The cap may be used with any type of smoking article. Throughout this specification, the term "smoking articles" should be inferred to mean, not only conventional cigarettes, in which the substrate, usually tobacco, is combusted, but also smoking articles, for example heated smoking articles, in which the substrate is heated rather than combusted and which rely on aerosol formation from the heated substrate, and distillation-based smoking articles, including those having a combustible heat source, such as the smoking article described in WO-A-2009/022232. The cap is particularly useful for extinguishing heated smoking articles in which an aerosol is generated by the transfer of heat from a combustible fuel element or heat source to a physically separate aerosol forming material, which may be located within, around or downstream of the fuel element.

As used herein, the terms 'combustible fuel element' and 'combustible heat source' refer to heat sources which are physically separate from the aerosol forming material and are combusted to heat the aerosol forming material, rather than the arrangement in conventional smoking articles in which the aerosol forming material, usually tobacco, is itself combusted, Such heat sources include, but are not limited to, combustible carbonaceous heat sources.

As used herein, the term 'combustion zone' is used to describe a portion of the smoking article which is combusting, or has been combusted.

As used herein, the term 'heat reactive material' is used to describe a material which changes shape or state of matter when exposed to heat. This includes materials which remain in the changed shape or state of matter when no longer exposed to heat, as well as materials which return to their undeformed shape or previous state of matter when no longer exposed to heat.

As used herein, the term 'deform' is used to describe the change of shape, dimensions, or shape and dimensions of an object, either elastically or plastically. This includes expansion and contraction.

As used herein, the phrase 'fits tightly against' is used to mean that at least part of the cap is in contact with the smoking article such that the cap applies a compressive force against the smoking article. This includes, but is not limited to, where the cap forms an airtight seal with the smoking article. The cap body may fit tightly against the combustion zone of the smoking article or against another part of the smoking article which is downstream of the combustion zone.

As used herein, the phrase 'substantially prevent a supply of air' is used to mean that fluid communication between the combustion zone of the smoking article and the exterior of the cap is restricted to such an extent that combustion of the smoking article is suppressed. This may include where only part of the combustion zone of the smoking article is enclosed in the cap, or where the entire combustion zone is enclosed in the cap, either on its own or along with one or more downstream components of the smoking article.

The end of the cap body which is opposite to the opening may be at least partially open. Preferably, the end of the cap body which is opposite to the opening is closed.

The cap body may be of any suitable shape. The cap body may be tubular. In certain embodiments, the cap body tapers outwardly towards the opening such that a stack can be formed by placing multiple caps one inside another. In a preferred embodiment, the cap body is cup shaped. In such embodiments, the end of the cap body which is opposite the opening may be at least partially open. Preferably, the end of the cap body which is opposite to the opening is closed. In certain embodiments, the cap may further comprise a non-stick layer arranged on an exterior of the cap body to facilitate removal of the cap from a stack of such caps.

The cap may be sized so as to be suitable for extinguishing a single smoking article at a time. In that case, the opening has a size such that only a single smoking article at a time can be received into the interior of the cap body. Preferably, the opening is substantially circular, so as to receive a smoking article having a substantially circular cross section.

If the cap is arranged to extinguish conventional smoking articles, the cap is sized to be suitable for extinguishing a single conventional smoking article at a time. Preferably, however, the cap is arranged to extinguish smoking articles including a combustible fuel element or heat source. In that case, the cap is sized to be suitable for extinguishing a single smoking article, including a combustible fuel element or heat source, at a time.

Preferably, the cap is arranged to extinguish smoking articles having a diameter between about 5 mm and about 9 mm. More preferably, the cap is arranged to extinguish smoking articles having a diameter between about 7 mm and about 8 mm. Preferably, the opening of the cap body has a cross section between about 8 mm and about 9 mm. More preferably, the opening has a cross section of about 8 mm.

The cap may be sized so as to enclose the entire combustion zone of a smoking article. Additionally, the cap may be sized so as to enclose one or more downstream components of the smoking article. Alternatively, the cap may be sized so as to enclose only part of the length of the combustion zone. Preferably, the interior of the cap body has a length of between about 5 mm and about 15 mm, more preferably the interior of the cap body has a length of about 9 mm. Throughout the specification, the term 'length' is used to denote the dimension in the longitudinal direction of that article.

The cap body may comprise any suitable material or materials.

In certain embodiments, the cap body is formed from heat reactive material. Alternatively, the heat reactive material is applied as a heat reactive coating on an interior surface of the cap body. The heat reactive coating may be applied over the entire interior surface of the cap body, or over part of the interior surface of the cap body, for example towards the opening.

As used herein, the term 'coating' is used to describe a layer of material that covers and is adhered to the inner surface of the cap body.

In certain embodiments, the heat reactive material comprises an intumescent material. As used herein, the term 'intumescent material' is used to describe a material that expands as a result of heat exposure, thus increasing in volume and decreasing in density.

The intumescent material may comprise any suitable material or materials. In certain embodiments, the intumescent material forms an insulating foam when exposed to heat from the combustion zone of a smoking article. In one embodiment, the intumescent material comprises a carbon source, such as starch or one or more pentaerythritols (or other types of polyalcohol), an acid source, such as ammonium polyphosphate, a blowing agent such as melamine, and a binder, such as soy lecithin. Additionally an agent that enhances the formation of the insulative foam could be added, such as chlorinated paraffins. In an alternative embodiment, the intumescent material comprises a mixture of sodium silicate and graphite such that a hard char foam may be produced when the intumescent material is exposed to heat from the combustion zone of a smoking article.

The intumescent material may be applied as a heat reactive coating formed by applying one or more intumescent varnishes, paints, lacquers, or any combination thereof on an interior surface of the cap body. For example, by brushing, rolling, dipping or spraying or by using intumescent paper or plastic-based sheet that is formed into the final shape of the cap by any known cap manufacturing processes, such as cutting, rolling and gluing systems or molding in the case of plastic-based material. In one embodiment, the intumescent material is a latex solution applied by spraying.

The intumescent material may expand by any suitable amount when exposed to heat from the combustion zone of a smoking article. Preferably, the intumescent material expands by a factor of between about 10 and about 100 times its original dimensions when exposed to heat from the combustion zone of a smoking article. Where the intumescent material is applied as a heat reactive coating on an interior surface of the cap body, preferably the thickness of the coating is from about 10 microns to about 100 microns and increases to from about 1 mm to about 2 mm when exposed to heat from the combustion zone of a smoking article.

Alternatively, or in addition, the heat reactive material may comprise a heat shrink material. As used herein, the term 'heat shrink material' is used to describe a material that shrinks as a result of heat exposure.

In certain embodiments, the heat shrink material may be a mechanically expanded polymer layer which returns to its unexpanded dimensions as a result of heat exposure. For example, the heat shrink material may be manufactured from a thermoplastic material such as nylon, polyolefin, fluoropolymer (such as FEP, PTFE or Kynar), PVC, neoprene, silicone elastomer, Viton, or any combination thereof. In certain embodiments, the heat shrink material is a fluoroplastic Kynar with a shrink temperature of about 135° C. and a shrink ratio of about 2:1. In such embodiments, the fluoroplastic Kynar may be moulded as a close-ended cup.

In certain embodiments, the heat shrink material is applied as a heat reactive coating on an inner surface of the cap body. In such embodiments, the coating may be applied by any suitable method. For example, the coating may be applied as a sheet or film which is co-extruded with, or adhered to, the cap body, for example by gluing or welding. Preferably the heat reactive coating is adhered to the cap body only in the region of the opening. This may increase the amount by which the opening of the cap body is deformed by the heat reactive coating to more effectively surround or enclose the combustion zone of a smoking article. It may also allow a layer of air to form between the cap body and the combustion zone to improve the thermal insulating properties of the cap. In one embodiment, the cap body comprises a cardboard cup and the heat shrink material comprises a polypropylene shrinking film that is applied over the inner surface of the cardboard cup and is adhered to the inner surface of the cardboard cup in the region of the opening.

Preferably, the cap body comprises a heat insulative material disposed outwardly from the heat reactive material. The term 'outwardly' is used to mean that the heat insulation layer is disposed towards the exterior of the cap body relative to the heat reactive material. In such embodiments, the heat insulative material may reduce heat transfer to the exterior of the cap. This may be particularly important when the cap is used with smoking articles including a combustible fuel element or heat source, because such smoking articles may have a heat source containing heat energy that should be dissipated to better facilitate easy disposal. Where a plurality of caps is provided in a stack, the heat insulative material can also prevent the activation of the heat reactive materials of adjacent caps in the stack. The heat insulative material may comprise any suitable material, for example cardboard, or an intumescent varnish, paint or latex. In one embodiment, the heat insulative material is made of a polypropylene shrinking film that is a applied on the entire inner surface of a cardboard cup but glued or welded only at the opening of the cup.

In certain embodiments, the cap body is formed from heat insulative material. In such embodiments, the heat reactive material may be applied as a heat reactive layer on an interior surface of the heat insulative material and where the cap comprises a non-stick layer, the non-stick layer may be applied to an exterior surface of the heat insulation layer.

According to a second aspect of the invention, there is provided a stack of caps comprising a plurality of caps according to the first aspect of the invention, the plurality of caps being stacked one inside another.

According to a third aspect of the invention, there is provided an extinguisher cap dispenser comprising: a housing portion defining a compartment for receiving a plurality of caps and comprising a compartment opening for receiving a combustion zone of a smoking article into the compartment; and a lid portion moveable between an open position and a closed position to open and close the compartment opening, wherein the compartment contains at least one cap according to the first aspect of the invention.

The dispenser is sized so as to be hand-held or portable, and is preferably suitable for extinguishing a single smoking article at a time. Additionally, the dispenser may be advantageously sized so that it unobtrusively clips to the bottom of smoking article packaging.

The external shape of the dispenser is preferably elongate in height with a cross section that is substantially rectangular. Other alternative suitable shapes may be used, including, for example, circular, oval, trigonal, octagonal, rhomboidal, trapezoidal, or any combination thereof. In certain preferred embodiments, the dispenser has a height of between about 50 mm and about 60 mm and a depth between about 13 mm and about 23 mm. The external dimensions of the extinguisher may be adjusted.

The housing may comprise any suitable material or materials. Suitable materials include, but are not limited to, metal, glass, polypropylene (PP), polyethylene (PE), polyamide (PA), polystyrene (PS) and silicone, or combinations thereof. In a preferred embodiment, the housing comprises polyamide. In certain preferred embodiments, the housing includes a melt resistant inner coating on an interior surface of the compartment. If present, the inner coating is preferably silicone.

The exterior surfaces of the housing may be printed, embossed, debossed or otherwise embellished with manufacturer or brand logos, trade marks, slogans and other consumer information and indicia. If a sticker is applied to an exterior surface of the housing, the sticker may be printed, embossed, debossed or otherwise embellished with manufacturer or brand logos, trade marks, slogans and other consumer information and indicia.

The compartment may be partially open or closed at the end opposite the compartment opening. The compartment may have any suitable shape and size. Preferably, the compartment is elongate in height with a cross-section that is substantially circular. Preferably, the compartment has an internal length of between about 30 mm and 50 mm, preferably of about 40 mm. Preferably, the compartment has an internal width of between 9 mm and 11 mm, preferably of about 10 mm. Other alternative suitable cross-sectional shapes may be used, including, for example, circular, oval, octagonal, rhomboidal, trapezoidal, or any combination thereof.

The compartment preferably has a size suitable for only one stack of extinguisher caps according to the first aspect of the invention. This reduces the overall size of the dispenser. For example, the compartment may have a width which is slightly larger than the diameter of a stack of extinguisher caps. Preferably, the compartment has an internal length suitable for a stack of caps which corresponds to the number of smoking articles provided in a standard pack of smoking articles. For example, the compartment may be sized so as to accommodate a stack of 20 caps. The compartment may extend completely across the interior of the housing or may extend only partially across the interior of the housing.

Preferably, the compartment opening is sized to receive a single smoking article into the compartment. If the dispenser is arranged to dispense caps for extinguishing conventional smoking articles, the compartment opening may be sized to be suitable for receiving a single conventional smoking article at a time. Preferably, however, the dispenser is arranged to dispense caps for extinguishing smoking articles including a combustible fuel element or heat source. In that case, the compartment opening is sized to be suitable for receiving a single smoking article, including a combustible fuel element or heat source, at a time.

Preferably, the compartment opening is sized to be suitable for receiving smoking articles having a diameter between about 5 mm and about 9 mm. More preferably, the compartment opening is sized to be suitable for receiving smoking articles having a diameter between about 7 mm and about 8 mm. Preferably, the compartment opening has a cross section between about 8 mm and about 9 mm. More preferably, the opening has a cross section of about 9 mm.

The compartment opening should be positioned such that a smoking article inserted into the compartment opening is received in the compartment.

Preferably, the dispenser comprises a lip defining the opening. The lip partially or completely bounds the opening. The lip may be curved. That is, the lip may have a curved profile, providing a smooth transition between the outer side and the inner side of the opening. For example, the lip may comprise a first portion on the outer side of the opening, a second portion on the inner side of the opening and a curved portion joining the first and second portions. Alternatively or additionally, the lip may be rounded. That is, the opening defined by the lip may have a rounded (for example, a circular) shape. The lip, which may be curved, rounded or both curved and rounded, may provide a smooth opening for receiving a smoking article. This may reduce the chance of breaking or damaging the smoking article or part of the smoking article. This is particularly advantageous if the smoking article comprises a combustible fuel element or heat source, because the fuel element or heat source may be fragile and prone to breakage. The lip, which may be curved, rounded or both curved and rounded, may also facilitate insertion of the smoking article into the opening and compartment. This is advantageous because the opening likely has a cross section similar to the diameter of a smoking article. Thus, there may be a tight fit between the smoking article and the opening.

Depending on the design of the dispenser, the lip, which may be curved, rounded or both curved and rounded, may form part of the housing. The lip may be a separate component arranged to be attached to the housing. The lip may comprise any suitable material. Preferably, the lip comprises stainless steel.

If the dispenser comprises a lip defining the opening, preferably, the lip is heat-resistant. The heat-resistant lip may reduce the chance of heat damage to the dispenser as the smoking article is received in the opening. This may be particularly advantageous if the smoking article comprises a combustible fuel element or heat source.

The lid may comprise any suitable material or materials. Suitable materials include, but are not limited to, polypropylene (PP), polyethylene (PE), polyamide (PA), polystyrene (PS) and silicone, or combinations thereof. In a preferred embodiment, the lid comprises polyamide.

The lid, when closed, prevents escape of caps from the dispenser by closing the compartment opening. The lid may be arranged to close any further openings which are provided in the dispenser, or additional lids for those openings may be provided.

The lid may have any form suitable for use with the dispenser. The lid may be separate from the housing or attached to the outer vessel. For example, the lid may be a snap-fit lid, a sliding lid, a hinge lid or a flip top lid. If the lid is attached to the housing, the lid may be formed integrally with the housing or may be fastened to the housing, for example using a hinge pin.

The exterior surfaces of the lid may be printed, embossed, debossed or otherwise embellished with manufacturer or brand logos, trade marks, slogans and other consumer information and indicia.

The dispenser may comprise means for attaching the dispenser to another object. Preferably, the dispenser further comprises a clip for attaching the dispenser to another object. For example, the clip may be arranged to attach the dispenser to a pack of smoking articles. Preferably, the smoking articles are smoking articles which can be extinguished by the extinguisher. The dimensions of the dispenser may be selected to match dimensions of the pack. For example, in one embodiment, the height of the dispenser may substantially match the width of the pack and the depth of the dispenser may substantially match the depth of the pack. Thus, the dispenser may unobtrusively clip to the bottom of the pack.

The clip may comprise any suitable material or materials, including, but not limited to stainless steel, for example stainless steel grade 1.4301, and stainless spring steel, or combinations thereof.

The clip may be integrally formed with a part of the dispenser, for example the housing or lid. Alternatively, the clip may be a separate component which is fixed to a part of the dispenser, for example the housing or lid. The clip may be fixed by any suitable means, for example, but not limited to, a snap-fit, a spring-fit, glue or fixing means, for example one or more screws.

According to a fourth aspect of the invention, there is provided a pack of smoking articles comprising a pack containing at least one smoking article; and a stack of caps according to the second aspect of the invention.

Packs of smoking articles according to the invention may have substantially the same construction as known packs of smoking articles including, but not limited to, hinge-lid packs, slide and shell packs, shoulder packs and booklet packs.

Packs of smoking articles according to the invention may be 'hard' packs. For example, packs according to the invention may be rigid hinge-lid containers comprising a box portion and a lid portion connected to the box portion along a hinge line extending across the rear wall of the container. In such embodiments, the extinguisher cap dispenser may be attached to the exterior of the box portion or the lid portion, or disposed within the box portion.

Alternatively, packs of smoking articles according to the invention may be rigid slide and shell containers having an outer shell and an inner slide or tray in which the smoking articles are housed and which is slidable within the outer shell. In such embodiments, the extinguisher cap dispenser may be attached to the exterior of the outer shell or disposed in the inner slide of the rigid slide and shell container.

In yet further embodiments, packs of smoking articles according to the invention may be 'soft' packs comprising a cup-shaped box containing a wrapped bundle of smoking articles.

If the dispenser is attached to the exterior of the pack, it may be attached by any suitable attaching means, for example, but not limited to, a clip, a snap-fit, a spring-fit, glue or fixing means, for example one or more screws. Where the dispenser is attached using a clip, the clip may be fixed to the dispenser or to the pack and by any suitable means, for example, but not limited to, a snap-fit, a spring-fit, glue or fixing means, for example one or more screws.

Packs of smoking articles according to the present invention may have one or more right-angled longitudinal edges, one or more right-angled transverse edges, one or more rounded longitudinal edges, one or more rounded transverse edges, one or more bevelled longitudinal edges, one or more bevelled transverse edges, or any suitable combination thereof. For example, by scoring in a known manner one or more laminar blanks from which the containers are produced, 'rounded-corner' and bevelled-corner' packs of smoking according to the invention may be produced.

Packs of smoking articles according to the invention may advantageously house smoking articles including, but not limited to, conventional lit-end cigarettes, cigars or cigarillos, heated smoking articles comprising a combustible fuel element or heat source and an aerosol-generating substrate (for example cigarettes of the type disclosed in U.S. Pat. No. 4,714,082) and smoking articles for use with electrical smoking systems (for example cigarettes of the type disclosed in U.S. Pat. No. 5,692,525).

It will be appreciated that through an appropriate choice of the dimensions of the packaging, packs of smoking articles according to the invention may house different total numbers of smoking articles or different arrangements of smoking articles. For example, containers according to the invention may house a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different numbers of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Alternatively or in addition, packs of smoking articles according to the invention may house smoking articles of different dimensions (for example, smoking articles of different length or different circumference). For example, the pack may house smoking articles with lengths of between about 40 mm and about 180 mm and diameters of between about 4 mm and about 9 mm.

Packs of smoking articles according to the invention may house filterless smoking articles and smoking articles with various filter tips. In addition, packs of smoking articles according to the invention may house smoking articles of the same type or brand, or of different types or brands (for example, smoking articles with different filters, tobacco blends, flavours, total particulate matter delivery, resistance to draw or nicotine delivery). Preferably, the dimensions of the container are adapted to the length of smoking articles, and the collation of the smoking articles housed therein. Typically, the external dimensions of the container are between about 0.5 mm and about 5 mm larger than the dimensions of the bundle or bundles of smoking articles housed therein.

Preferably, packs of smoking articles according to the invention house a plurality of smoking articles wrapped in an inner liner of, for example, metal foil or metallised paper.

Packs of smoking articles according to the invention may be overwrapped in a known manner with any suitable known material or combination of materials including, but not limited to, cellophane, polymeric films of, for example, polyethylene or polypropylene, metallised polymeric films and laminated polymeric films. Packs of smoking articles according to the invention may be overwrapped with overwrappers including one or more tear tapes. The one or more tear tapes may extend in a transverse or longitudinal direction around the perimeter of the container.

According to a fifth aspect of the invention, there is a provided a container for a pack of smoking articles comprising packaging for forming a pack of smoking articles according to the fourth aspect of the invention and at least one cap according to the first aspect of the invention.

The invention will be further described, by way of example only, with reference to the accompanying drawings in which.

Figure 1:
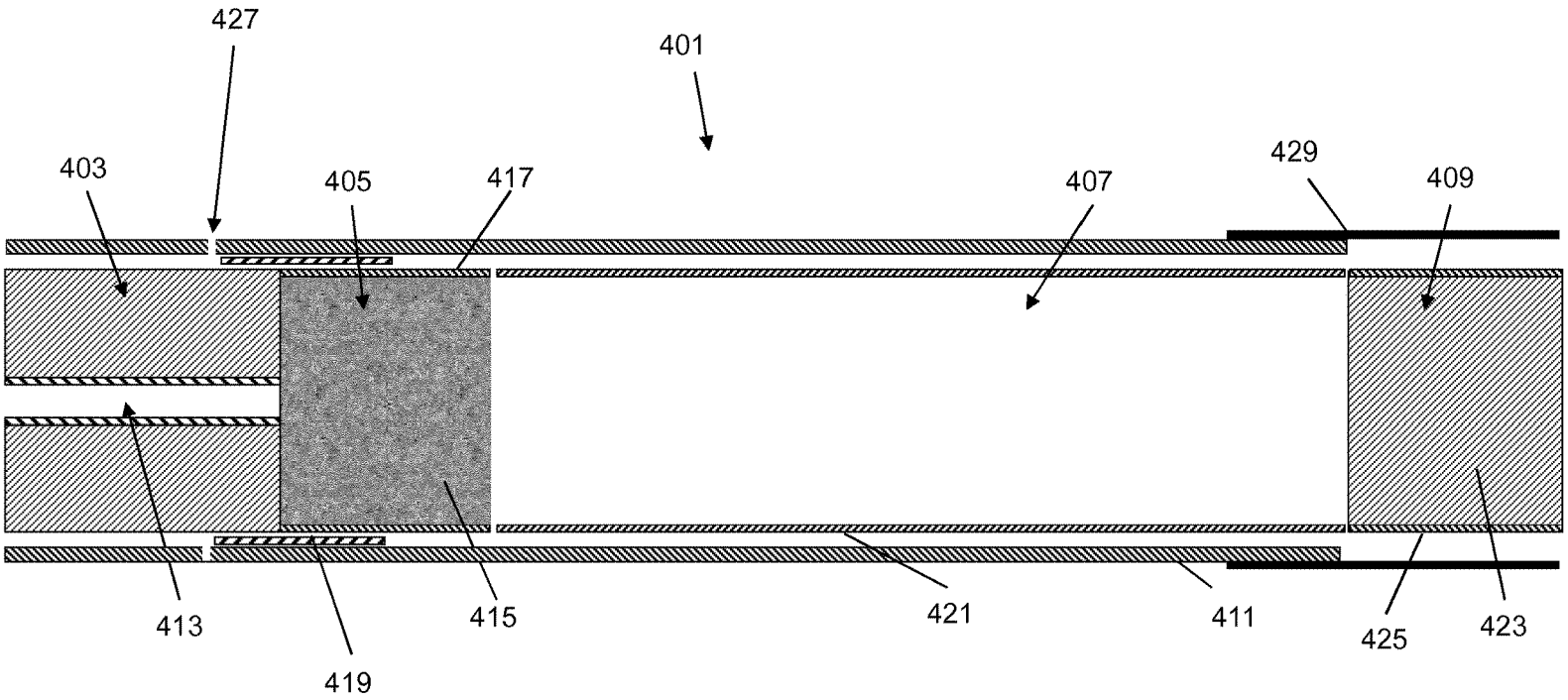
FIG. 1 shows a smoking article including a combustible heat source.

FIG. 1 shows one example of a smoking article with which the cap of the invention may be used. FIG. 1 shows a smoking article similar to that described in WO-A-2009/022232. The smoking article S comprises a combustible heat source 403, an aerosol-generating substrate 405, an elongate expansion chamber 407 and a mouthpiece 409 in abutting coaxial alignment, which are overwrapped in an outer wrapper of cigarette paper 411. The combustible heat source 403 is cylindrical and comprises a central airflow channel 413 which extends longitudinally through the heat source 403. The aerosol-generating substrate 405 is located immediately downstream of the combustible heat source 403 and comprises a cylindrical plug of homogenised tobacco material 415 comprising glycerine as aerosol former and circumscribed by filter plug wrap 417. A heat-conducting element 419, consisting of a tube of aluminium foil, surrounds and is in contact with a rear portion of the combustible heat source 403 and an abutting front portion of the aerosol-generating substrate 405. The elongate expansion chamber 407 is located downstream of the aerosol-generating substrate 405 and comprises a cylindrical open-ended tube of cardboard 421. The mouthpiece 409 is located downstream of the expansion chamber 407 and comprises a cylindrical plug of cellulose acetate tow 423 circumscribed by filter plug wrap 425. In this embodiment, the outer wrapper of cigarette paper 411 includes perforations 427 around its circumference, just upstream of the heat conducting element 419. The smoking article 401 is circumscribed by tipping paper 429.

The cap of the present invention may be used to extinguish any smoking article, but finds particular application as an extinguisher for smoking articles like the one shown in FIG. 1.

Figure 2:
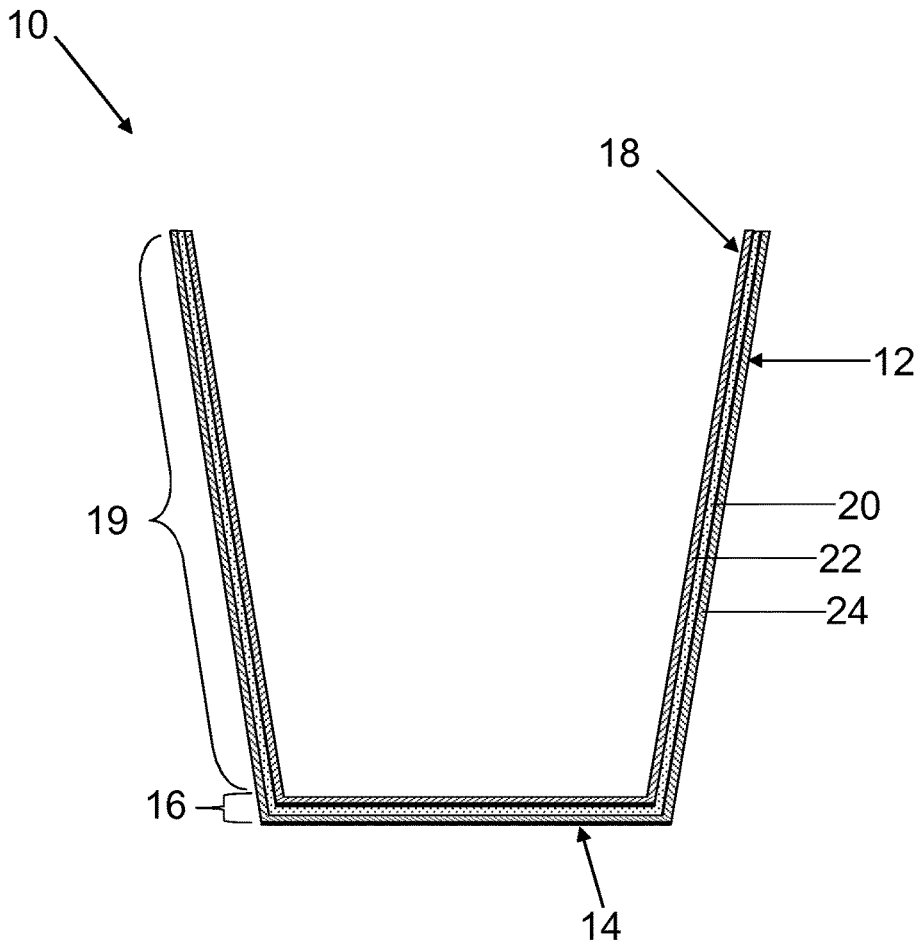
FIG. 2 shows a schematic cross-section of an extinguisher cap according to a first embodiment of a first aspect the invention.
Figure 3:
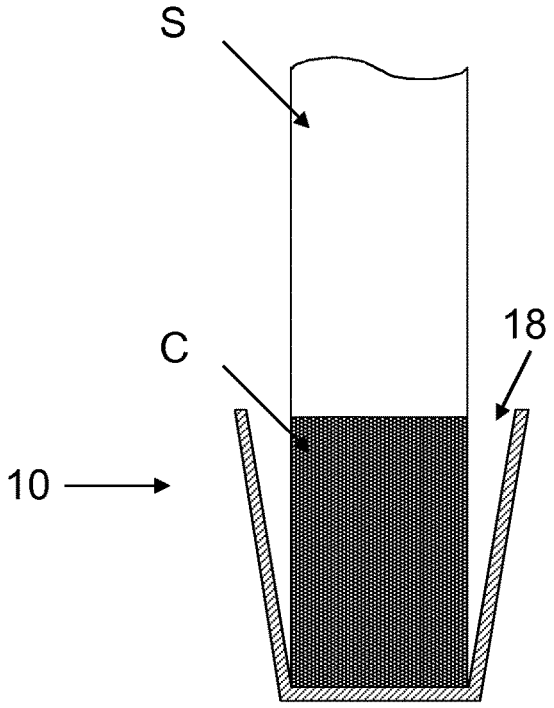
FIG. 3 shows a schematic cross-section of the extinguisher cap of FIG. 2, with a smoking article inserted through its opening and with the heat deformable material in an initial, undeformed condition.
Figure 4:
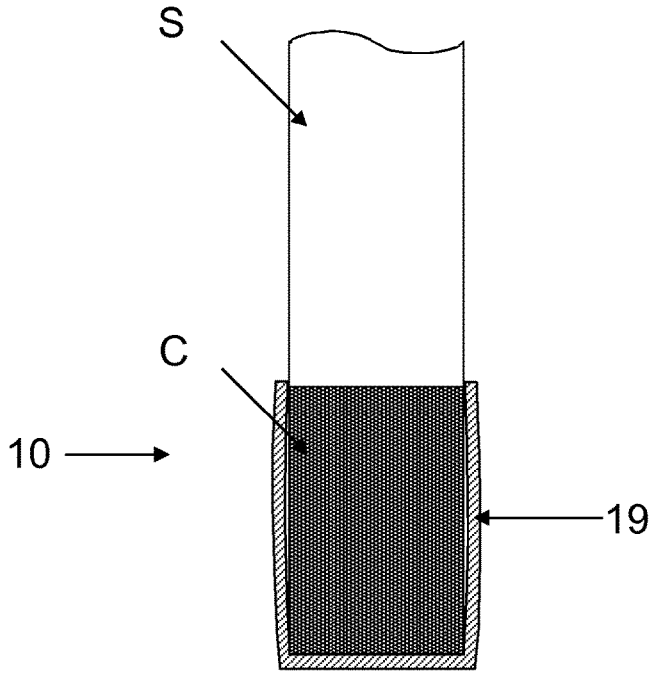
FIG. 4 shows a schematic cross-section of the extinguisher cap of FIG. 2, with a smoking article inserted through its opening and with the heat deformable material in a subsequent, deformed condition.

FIGS. 2 to 4 are cross-sectional views of a cap according to a first embodiment of the first aspect of the invention. FIG. 2 shows the composition of the cap. FIG. 3 shows a cap into which a smoking article has been inserted, with the cap in an undeformed condition. FIG. 4 shows a cap into which a smoking article has been inserted, with the cap in a deformed condition.

Referring to FIG. 2, the cap 10 comprises a hollow, tubular cap body 12 having a closed, lower end 14 terminating in a cap end wall 16 and an opening 18 defined by an annular side wall 19 which extends upwardly and outwardly from the end wall 16. Cap 10 has a three layer construction, with a heat insulation layer 20 sandwiched between a heat reactive layer 22 on the interior surface of the cap 10 and a non-stick layer 24 on the exterior surface of the cap 10. The heat reactive layer 22 is a layer of heat shrink material, which is bonded to the inner surface of the heat insulation layer 20. The non-stick layer 24 is a non-stick coating, which is applied over the exterior surface of the heat insulation layer 20. The non-stick layer 24 makes it easier to remove individual caps 10 from either end of a stack formed from multiple caps 10 placed one inside another.

To extinguish a burning smoking article S using cap 10, a user inserts the combustion zone C end, or "lit end", of the smoking article S into the opening 18 of the cap 10, as shown in FIG. 3. The heat emitted by the combustion zone C of the smoking article S causes the heat reactive layer 22 to relax back to its unexpanded state, that is, to "shrink". As a result, the side wall 19 of the cap body 12 closes in on the smoking article S until the side wall 19 fits tightly against the smoking article S, as shown in FIG. 4. Once the cap 10 is tight against the tip of the smoking article S, the heat insulation layer 20 restricts the flow of heat from the combustion zone C to prevent the user from being burned if the outer surface of the cap 10 is touched. The tight fit between the side wall 19 of the cap 10 and the smoking article S restricts the supply of oxygen to the combustion zone C, preventing combustion from being maintained. When combustion stops, the combustion zone C cools and the smoking article S, along with the cap 10, can be safely disposed of by the user.

Figure 5:
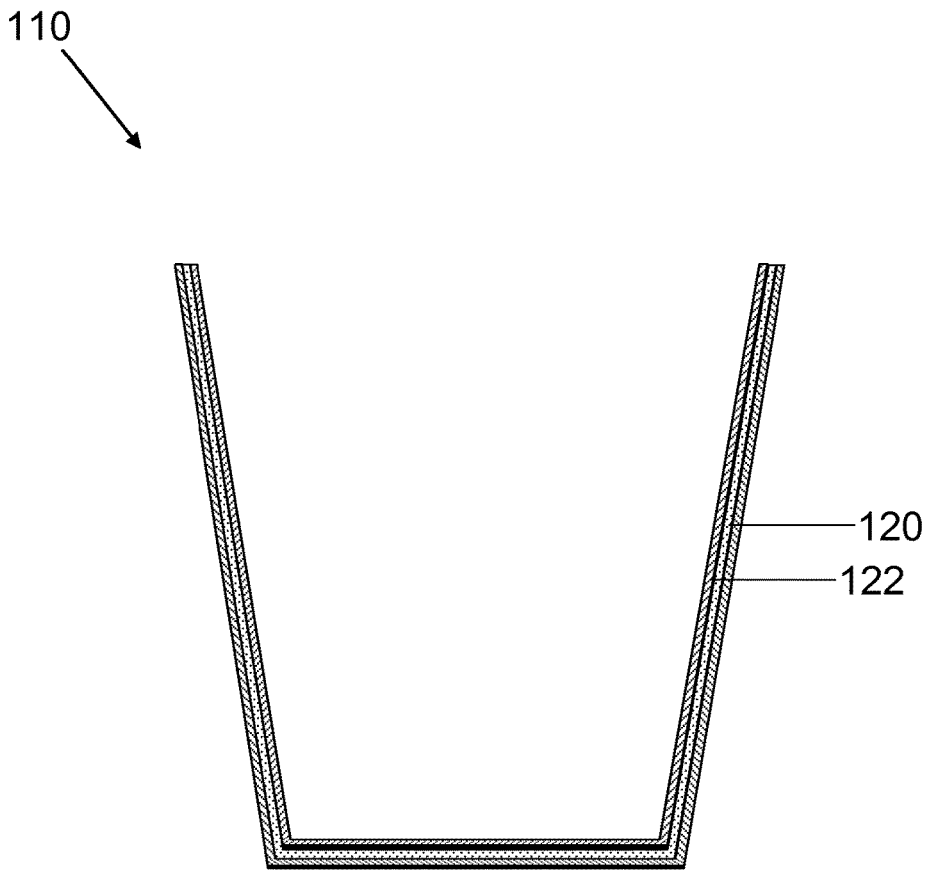
FIG. 5 shows a schematic cross-section of an extinguisher cap according to a second embodiment of the first aspect of the invention.
Figure 6:
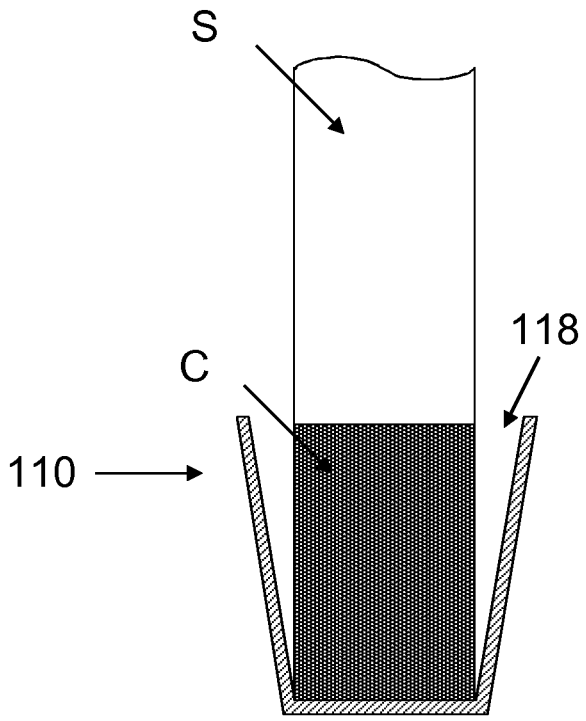
FIG. 6 shows a schematic cross-section of the extinguisher cap of FIG. 5, with a smoking article inserted through its opening and with the heat deformable material in an initial, undeformed condition.
Figure 7:
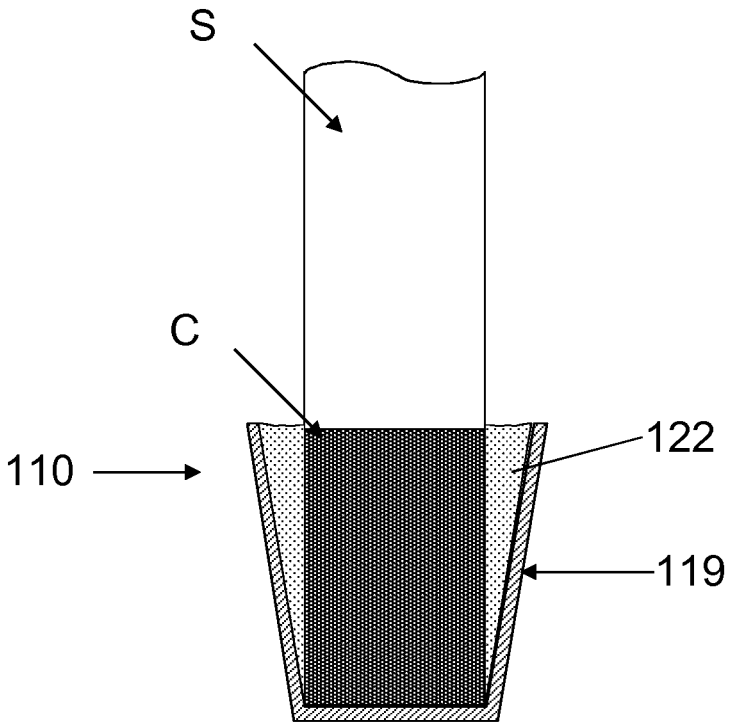
FIG. 7 shows a schematic cross-section of the extinguisher cap of FIG. 5, with a smoking article inserted through its opening and with the heat deformable material in a subsequent, deformed condition.

FIGS. 5 to 7 are cross-sectional views of a cap according to a second embodiment of the first aspect of the invention. FIG. 5 shows the composition of the cap. FIG. 6 shows a cap into which a smoking article has been inserted, with the cap an undeformed condition. FIG. 7 shows a cap into which a smoking article has been inserted, with the cap in a deformed condition.

Referring to FIG. 5, the cap 110 according to the second embodiment of the invention is of largely identical construction to the cap 10 according to the first embodiment of the invention. However, in cap 110, the heat reactive layer 122 is an intumescent lacquer, which is applied as coating to the interior of the heat insulation layer 120.

To extinguish a burning smoking article S using cap 110, a user inserts the combustion zone C end, or "lit end", of the smoking article S into the opening 118 of the cap 110, as shown in FIG. 6. The heat emitted by the combustion zone C of the smoking article S causes the heat reactive layer 122 to expand into the space between the side wall 119 of the cap 110 and the smoking article S, forming an insulating foam. As a result, the expanded heat reactive layer 122 fits tightly against the smoking article S, as shown in FIG. 7. Once the cap 110 is tight against the tip of the smoking article S, the heat insulation layer 120 restricts the flow of heat from the combustion zone C to prevent the user from being burned if the outer surface of the cap 110 is touched. As with the cap 10 according to the first embodiment, the deformation of the heat reactive layer 122 restricts the supply of oxygen to the lit end, preventing combustion from being maintained. When combustion stops, the combustion zone C cools and the smoking article S, along with the cap 110, can be safely disposed of by the user.

Figure 8:
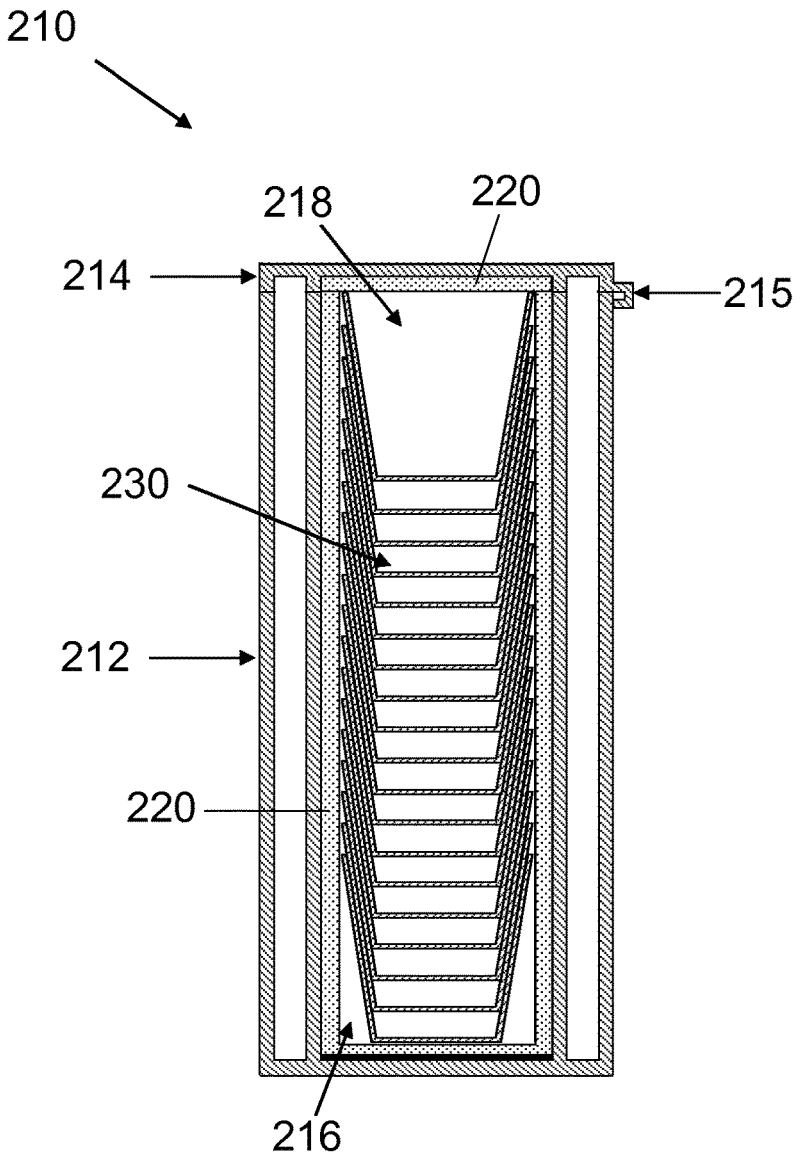
FIG. 8 shows a schematic cross-section of an extinguisher cap dispenser according to a second aspect of the invention, with the lid closed.
Figure 9:
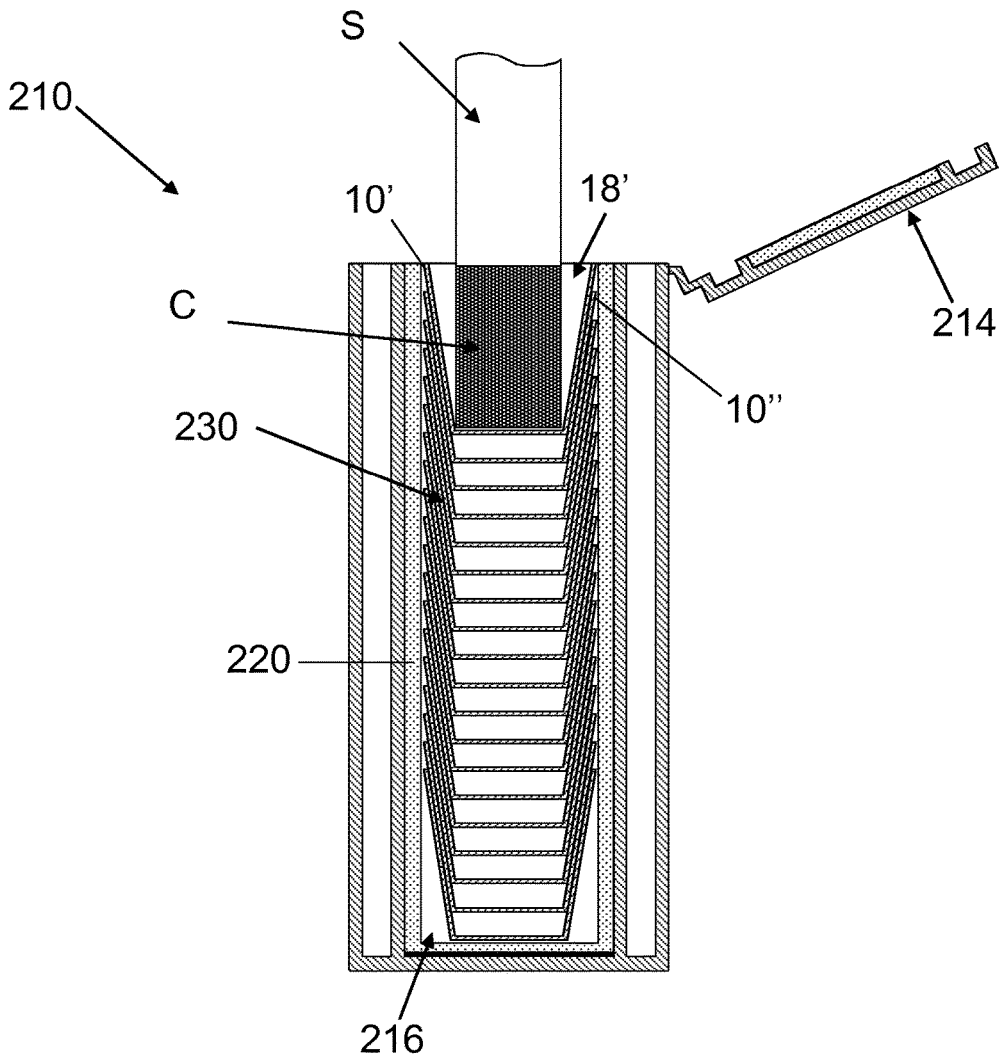
FIG. 9 shows a schematic cross-section of the extinguisher cap dispenser of FIG. 8, with the lid open and a smoking article inserted into the compartment opening.

FIGS. 8 and 9 are cross-sectional views of a dispenser according to a second aspect of the invention. FIG. 8 shows the dispenser with its lid closed and FIG. 9 shows the dispenser with its lid open and a smoking article in the compartment opening.

Referring to FIG. 8, the dispenser 210 generally comprises a cylindrical housing portion 212, with a rectangular cross-section, and a lid portion 214 hinged to the housing 212 by a film hinge 216. The housing 212 and the lid 214 are formed from injection moulded polyamide.

In the following description of the dispenser the terms "upper" and "top", "bottom" and "lower" and "front" and "rear", are used to describe the relative positions of components of the dispenser when the dispenser is held in an upright position by a consumer during opening so that the caps in the dispenser may be removed through the top side of the open dispenser. These terms are used irrespective of the actual orientation of the dispenser.

The housing 212 has a front wall, a right side wall, a left side wall, a rear wall and a bottom wall. The lid 214 similarly has a front wall, a right side wall, a left side wall and a rear wall, which function respectively as continuations of the corresponding walls of the housing 212 when the lid 214 is closed. The lid 214 of the dispenser 210 further includes a top wall, which opposes the bottom wall of the housing 212 when the lid 214 is closed. Within the housing 212 is a cylindrical compartment 216 for storing a plurality of extinguisher caps. The compartment has an opening 218 for receiving a smoking article into the compartment 216. The compartment 216, and the corresponding portion of the lid 214, are lined with a melt resistant liner 220, such as silicone, which has been 2K injection moulded with the housing 212 and the lid 214. The caps are arranged in the chamber 216 as a stack 230, with the open, upper end of each cap facing upwards, that is, towards the opening 218 of the compartment 216.

To remove a cap 10' from the dispenser 210, the user opens the lid 214 to access the compartment opening 218 and inserts the combustion zone C of a smoking article S into the compartment 216 and into the open, upper end 18' of the uppermost cap 10' in the stack 230, that is the cap 10' in the stack 230 nearest the compartment opening 218, as shown in FIG. 9. The heat from the combustion zone C of the smoking article S deforms the heat reactive layer of the cap 10', as described above in relation to either the first or second embodiments of cap, causing the cap 10' to form a tight fit around the smoking article S. While the smoking article S is in the compartment 216, the melt resistant liner 220 lining the compartment 216 protects the internal walls of the compartment 216 from damage which might otherwise occur due to heat from the combustion zone C and the heat insulation layer of the uppermost cap 10' insulates the adjacent cap 10" in the stack 230 from the heat of the combustion zone C. Thus, undesired deformation of the adjacent cap 10" in the stack 230 can be prevented. The smoking article S is then removed from the dispenser 210, along with the cap 10', and the lid 214 is shut to close the compartment 216.

Figure 10:
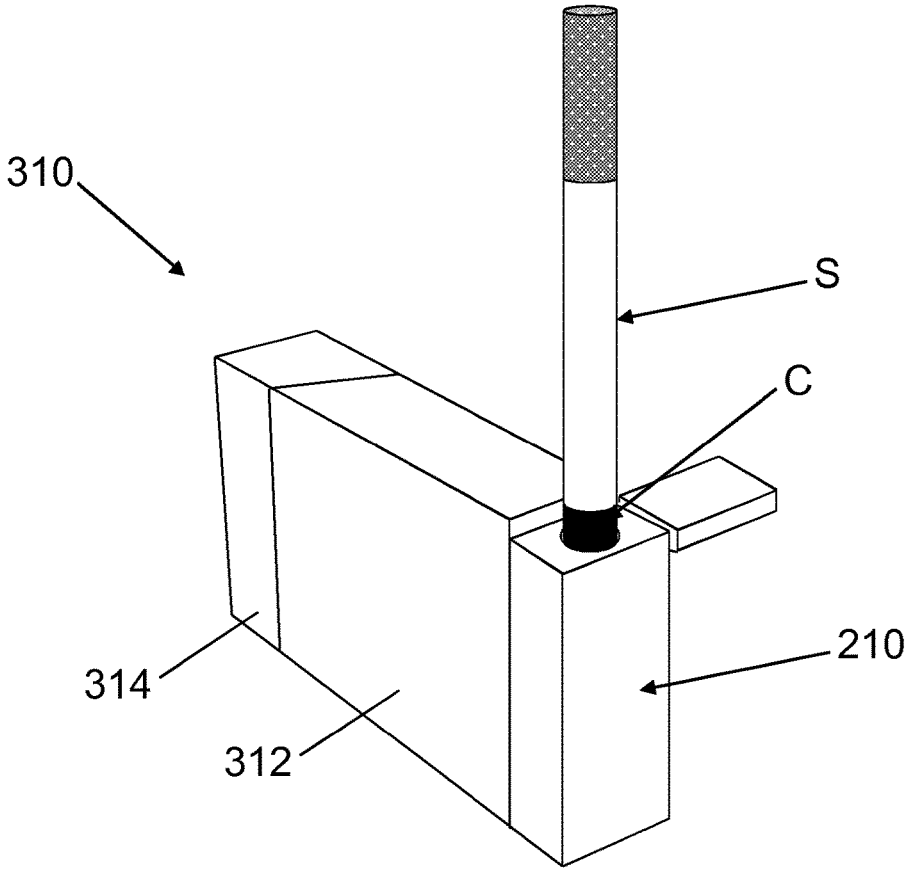
FIG. 10 shows a schematic rear perspective view of a pack of smoking articles in accordance with a third aspect of the invention, showing the dispenser lid open and a smoking article inserted into the compartment opening.
Figure 11:
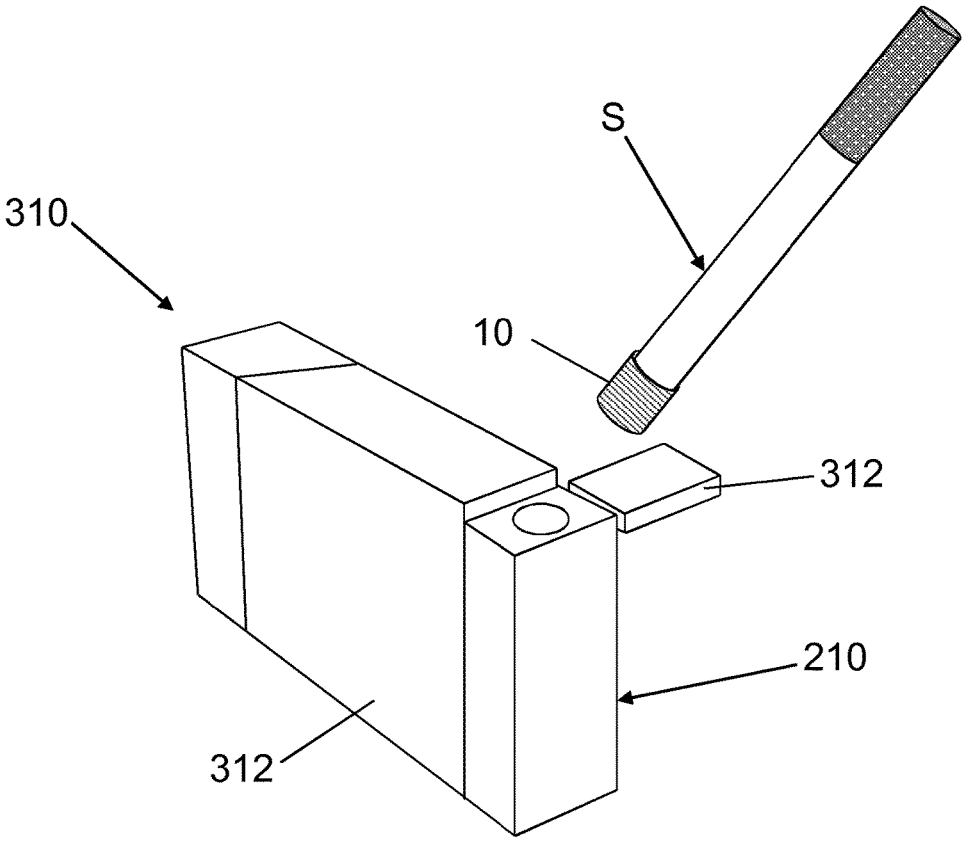
FIG. 11 shows a schematic rear perspective view of the pack of FIG. 10, with a smoking article having an extinguisher cap that has been removed from the dispenser.

FIGS. 10 and 11 are perspective views of a pack of smoking articles according to the invention. As shown in FIG. 10, the dispenser 210 forms part of a pack of smoking articles 310. The pack 310 is a hinge-lid container of smoking articles which generally comprises a lower box portion 312 and an upper lid portion 314, which is hinged to the lower box portion 312 along a horizontal hinge line that extends across the rear of the hinge-lid container 310. The lower box portion 312 and the upper lid portion 314 have the same general construction as the box portion and the lid portion of a conventional hinge-lid cigarette pack having right-angled vertical edges and right-angled horizontal edges. The lower box portion 312 and upper lid portion 314 are formed from a single, folded, one-piece, laminar board blank.

In the following description of the hinge-lid container the terms "upper" and "top", "bottom" and "lower" and "front" and "rear", are used to describe the relative positions of components of the hinge-lid container when the container is held in an upright position by a consumer during opening so that the smoking articles in the container may be removed through the top side of the open container. These terms are used irrespective of the actual orientation of the hinge-lid container.

The lower box portion 312 has a front wall, a right side wall, a left side wall, a rear wall and a bottom wall. The upper lid portion 314 similarly has a front wall, a right side wall, a left side wall and a rear wall, which function respectively as continuations of the corresponding walls of the lower box portion 312 when the lid portion 314 is closed. The upper lid portion 314 of the hinge-lid container 310 further includes a top wall, which opposes the bottom wall of the lower box portion 312 when the upper lid portion 314 is closed.

The dispenser 210 is attached to the bottom wall of the lower box portion 312 along its left side wall, so that the lid 214 of the dispenser may be opened and a cap 10 removed from the upper end of the dispenser 210 in order to extinguish a smoking article S, as shown in FIG. 11 and as discussed above in relation to FIGS. 8 and 9.

The invention claimed is:

1. A cap for extinguishing a smoking article, the cap comprising:

a hollow cap body having an opening configured to receive a combustion zone of a smoking article, the cap body comprising a heat reactive material configured to deform in response to heat from the combustion zone such that at least part of the cap body fits tightly against the smoking article to substantially prevent a supply of air to the combustion zone, wherein the cap body tapers outwardly towards the opening such that a stack of such caps can be formed by placing one inside another: and a non-stick layer disposed on an exterior of the cap body and configured to facilitate removal of the cap from the stack of the caps.

2. A stack of caps, comprising;

a plurality of caps according to claim 1, wherein said each cap is placed one inside another.

3. An extinguisher cap dispenser, comprising:

a housing portion defining a compartment configured to receive a plurality of caps and comprising a compartment opening configured to receive a combustion zone of a smoking article into the compartment; and a lid portion moveable between an open position and a closed position and being configured to open and to close the compartment opening, wherein the compartment contains at least one cap according to claim 1.

4. The extinguisher cap dispenser according to claim 3, wherein the compartment is sized to accommodate a single stack of caps arranged such that only a cap of the single stack that is nearest the compartment opening is accessible by a user, and wherein said each cap is placed one inside another.

5. The extinguisher cap dispenser according to claim 3, wherein the compartment contains a stack of the caps wherein said each cap is placed one inside another.

6. A pack of smoking articles, comprising:

a container containing at least one smoking article; and a stack of a plurality of caps according to claim 1, wherein said each cap is placed one inside another.

7. The cap according to claim 1, wherein the heat reactive material comprises an intumescent material.

8. The cap according to claim 1, wherein the heat reactive material is a heat reactive coating on an interior surface of the cap body.

9. The cap according to claim 1, wherein the heat reactive material comprises a heat shrink material.

10. The cap according to claim 1, wherein the cap body further comprises a heat insulating material disposed outwardly from the heat reactive material.

11. The cap according to claim 1, wherein the cap body is cup shaped.

12. The cap according to claim 1, wherein an end of the cap body opposite the opening is closed.

* * * * *